US005873020A

United States Patent [19]

Matsuura et al.

[11] Patent Number: 5,873,020

[45] Date of Patent: Feb. 16, 1999

[54] FIXING DEVICE WITH ENDLESS BELT

[75] Inventors: Masahiko Matsuura, Suita; Eiichi Sano, Takatsuki, both of Japan

[73] Assignee: Minolta Co., Ltd., Osaka, Japan

[21] Appl. No.: 747,403

[22] Filed: Nov. 12, 1996

[30] Foreign Application Priority Data

Nov. 13, 1995 [JP] Japan ..... 7-294342
Dec. 13, 1995 [JP] Japan ..... 7-324423

[51] Int. Cl.[6] ..... G03G 15/20

[52] U.S. Cl. ..... 399/329

[58] Field of Search ..... 399/329, 330, 399/331, 67, 328; 219/216

[56] References Cited

U.S. PATENT DOCUMENTS

| | | | |
|---|---|---|---|
| 4,071,735 | 1/1978 | Moser . | |
| 4,242,566 | 12/1980 | Scribner | 219/216 |
| 5,099,288 | 3/1992 | Britto et al. | 399/320 |
| 5,250,998 | 10/1993 | Ueda et al. | 399/329 |
| 5,319,429 | 6/1994 | Fukuchi et al. | 399/321 |
| 5,345,300 | 9/1994 | Uehara et al. | 399/329 |
| 5,359,401 | 10/1994 | Uehara et al. . | |
| 5,410,394 | 4/1995 | Wayman et al. | 399/329 |
| 5,439,424 | 8/1995 | Dalal et al. . | |
| 5,465,146 | 11/1995 | Higashi et al. . | |
| 5,614,999 | 3/1997 | Kanesawa et al. | 399/329 |

FOREIGN PATENT DOCUMENTS

| | | |
|---|---|---|
| 60-151677 | 8/1985 | Japan . |
| 04-296786 | 10/1992 | Japan . |
| 4-324476 | 11/1992 | Japan . |
| 05-27620 | 2/1993 | Japan . |
| 6-289748 | 10/1994 | Japan . |
| 92/06417 | 4/1992 | WIPO . |

*Primary Examiner*—Robert Beatty
*Attorney, Agent, or Firm*—Burns, Doane, Swecker & Mathis, LLP

[57] ABSTRACT

A fixing device includes a heater and a fixing belt entrained around first and second supporting rollers. A pressure roller is arranged outside the belt. Also, an elastic forcing member is arranged inside the belt to force a portion of the belt running between the two supporting rollers against the pressure roller so that the belt portion is brought into circumferential contact with the pressure roller to form an extended nipping region. In addition, a braking device connected to an upstream support roller stretches the belt at the nip region. With this arrangement enough amount of heat is supplied to a recording medium and toner image flattening is prevented.

14 Claims, 5 Drawing Sheets

FIXING DEVICE WITH ENDLESS BELT

FIELD OF THE INVENTION

The present invention relates to a fixing device for use in an electrophotographic image forming apparatus such as copier, printer, and facsimile. More particularly, the invention is directed to a fixing device which includes an endless fixing belt for fusing and then fixing a toner powder image supported by a recording medium onto the same recording medium.

BACKGROUND OF THE INVENTION

A typical electrophotographic image forming apparatus includes a fixing device for fusing and then fixing a toner powder image supported by a recording medium onto the same substrate. One well known such fixing device is a roller fixing device which includes a heat roller having a heat generator therein and a pressure roller arranged parallel to and in circumferencial contact with the heat roller to form a nipping region therewith. With this roller fixing device, the sheet substrate supporting the unfixed toner powder image is transported into the nipping region where the toner powder image is fused and then fixed onto the recording medium.

However, this roller fixing device has a drawback that the nipping region is so small that the rollers must be rotated in a rather lower speed for fixing the entire toner powder image onto the sheet. This further limits a speed of image forming. One approach for overcoming this drawback is to elevate a pressure applied on the pressure roller towards the heat roller, thereby increasing a fixing ability of the device. This technique is effective for fixing the toner powder image on the substrate sheet, but has serious disadvantage that the toner powder image is flattened by the elevated pressure, which leads a deterioration of the resultant image.

In place of the roller fixing device, a belt fixing device using an endless fixing belt is disclosed in Laid-Open JPA 60-151677. This belt fixing device is shown in FIG. 8. The belt fixing device 100 comprises a fixing roller 101 made of metal. The fixing roller 101 includes a heat generator, or lamp 102, therein. The fixing roller 101 is covered at its outer periphery with an offset-preventing material such as fluoroethylene or silicone. The fixing device 100 also comprises a drive roller 103 drivingly connected with a motor (not shown), a trailing roller 104, and an assist roller 105. An endless belt 106 is entrained around these three rollers 103, 104, and 105. Also, the fixing roller 101 is arranged in circumferential contact with a portion of the belt 106 between the drive roller 103 and the assist roller 105 to form an extended nipping region 107.

With this belt fixing device 100, a recording medium 109 supporting an unfixed toner powder image 110 is transported in a direction indicated by an arrow 111 into the nipping region 107 and then the toner powder image 110 is pressure-fixed by a contact with the fixing roller 101 heated by the lamp 102.

This pressure roller fixing device 100, however, needs a separator for separating the sheet 109 which has moved past the nipping region 107 from the fixing roller 101. Also, to accelerate the fixing and then printing, a portion of the belt 106 that has touched with the recording medium 109 in the nipping region 107 and has been deprived of heat must be re-heated ps soon as possible up to an elevated temperature required for fixing. This requirement prohibits the use of fixing roller made of elastic material such as silicone rubber having low thermal conductivity. Therefore, a metal roller is typically employed for the fixing roller 101 though, this results in the flattening of the fixed toner image to eventually deteriorate the image. Particularly, a full-color toner image which is formed by superimposing a plurality of toner images of different colors is easy to be flattened, which deteriorates the image too much.

Another belt fixing device shown in FIG. 9 is disclosed in Laid-Open JPA 4-324476. This belt fixing device 120 comprises a pair of parallel heat rollers 121 and 122 including respective heaters 123 and 124. An endless belt 125 is entrained around the rollers 121 and 122. A pressure roller 126 is so forced against the rollers 121 and 122 as to be in circumferential contact with a lower span of the belt 125 to form an extended nipping region 127 therewith. Two thermal sensors 128 and 129 are arranged inside the belt 125 to contact with respective peripheral surfaces of the rollers 121 and 122 for detecting temperatures thereof. Outputs of the sensors 128 and 129 are used for switching the heaters 123 and 124, respectively.

Further, the belt 125 is made from a thin walled belt of metal such as nickel having a high thermal conductivity and the outer surface thereof is covered by the offset-preventing material, and the heat rollers 121 and 122 appears to be made of metal having high thermal conductivity. The pressure roller 126 comprises a mandrel (not shown) and a relatively thick elastic layer 130 mounted therearound.

With this belt fixing device 120, a recording medium 131 bearing an unfixed toner image 132 is transported through the nipping region 127. Thereby, the toner image 132 is heated by contact with the heated belt 125 and then fixed on the recording medium 131.

This belt fixing device is also effective for heating the recording medium 131 and the toner image 132, but the metal rollers 63 and 64 are pressed against the toner image on the recording medium 131 through the belt 65. This causes the flattening of toner image and deteriorates the image.

SUMMARY

Accordingly, an object of the invention is to provide an improved belt fixing device capable of being employed in a high speed image forming apparatus, and more particularly in a full-color image forming apparatus which requires high quality image.

To this end, the belt fixing device of the instant invention comprises an endless fixing belt entrained around first and second roller. A third roller is disposed outside the belt and an elastic forcing member is disposed inside the belt for forcing a portion of the belt towards the third roller to make it in circumferential contact with the third roller and thereby forming an extended nipping region. The belt fixing device further includes a heater for heating another portion of the belt moving towards the nipping region.

According to the invention, an unfixed toner powder image supported on a recording medium is transported into the extended nipping region where the toner image is fully fused and fixed on the recording medium. This permits the belt fixing device of the invention to be employed both in the high speed image forming apparatus and the full-color image forming apparatus. Further, the unfixed toner image is softly pressed by the elastic pressing member, which prevents the toner image from being flattened.

Another aspect of the invention includes drive means for rotating the belt and control means for stretching and thereby pressing a portion of the belt against the pressure roller to form an extended nipping region therewith.

According to the invention, the belt portion is brought into close contact with the pressure roller so that the recording medium with the unfixed toner image is nipped firmly and fixed entirely.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

PREFERRED EMBODIMENT OF THE INVENTION

(1) FIRST EMBODIMENT

Figure 1:
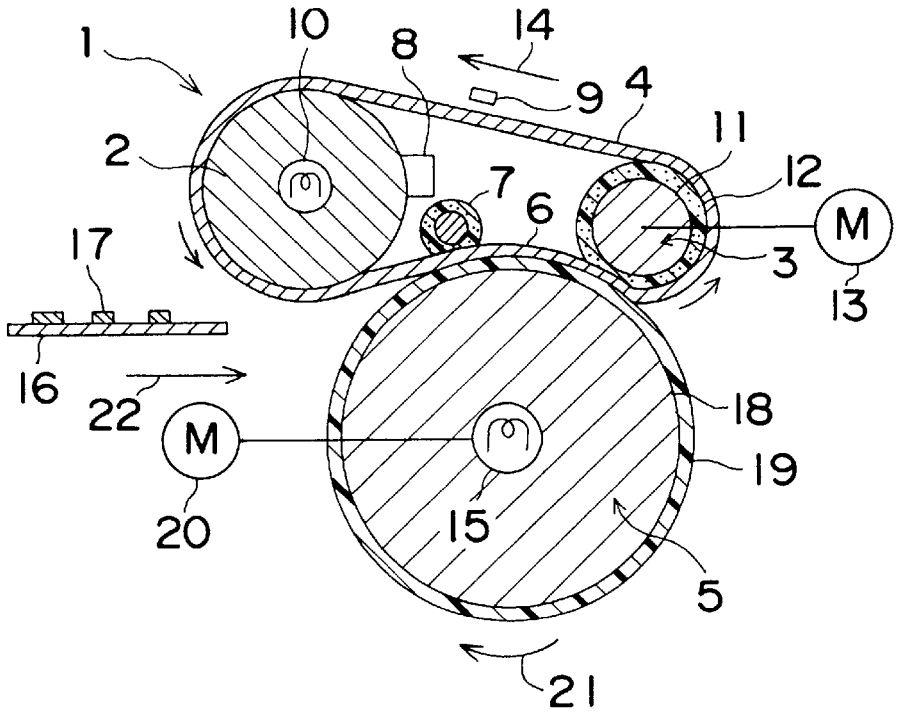
FIG. 1 is a sectional view of a belt fixing device of the first embodiment.

Referring to FIG. 1, a belt fixing device 1 of the invention includes a rotatably mounted heat roller 2, a drive roller 3 arranged parallel to and spaced apart from the heat roller 2, and a walled endless fixing belt 4 entrained around the rollers 2 and 3. Also, a pressure roller 5 is so arranged under the belt 4 and forced to the drive roller 3 as to be in circumferential contact with a portion of the belt 4 to form an extended nipping region 6 therewith.

An assist roller 7 is arranged inside the belt 4 and adjacent one end of the nipping region 6 so that a lower span of the belt is stretched and thereby pressed against an outer periphery of the pressure roller 5. A thermal sensor 8 is so arranged inside the belt 4 while being in contact with an outer periphery surface of the heat roller 2 but apart from the belt 4 so that, according to an output of the sensor 8, a surface temperature of the heat roller 2 can be controlled. Further, another sensor 9 for detecting a steering of the belt 4 in its transverse direction is arranged adjacent one circumferential edge of the belt 4.

The heat roller 2 includes therein a heat generator, or heater 10. This heater 10 is switched on and off on the basis of the output of the thermal sensor 8 and thereby the surface temperature of the heat roller 2 is adjusted. The heat roller 2 is preferably made of metal such as aluminum, nickel, or iron having high thermal conductivity and in this embodiment the heat roller 2 is made from an aluminum pipe. Connected with one end of the heat roller 2 is a belt controller (not shown) which moves ups and downs the end to cancel the steering of the belt 4 when the steering has been detected by the sensor 9. This ensures the belt 4 to travel along a predetermined path.

The belt 4 is preferably made from a film of resin such as polyamide, polyetherimide, polyamideimide, polyestersulfone, polyetherketone, or a film of metal such as nickel. Further, the outer periphery of the belt 4 is preferably coated with an offset-preventing layer made of resin such as silicone or fluoroethylene.

The drive roller 3 comprises a mandrel 11 made of aluminum and an outer layer 12 which covers the outer periphery surface of the mandrel 11. The outer layer 12 is preferably made of elastic heat-resisting material such as silicone rubber. Not limited thereto, but other materials having similar heat conductivity, heat resistance, and elasticity can be used instead.

Further, the drive roller 3 is drivingly connected with a drive motor 13 so that upon driving of the motor 13 the drive roller 3 rotates to carry the belt 4 in the direction indicated by arrow 14.

The pressure roller 5 includes at its center an assistant heater 15 which additionally heats a recording medium 16 and a toner image 17 supported thereon. Similar to the drive roller 3, the pressure roller 5 comprises a metal mandrel 18 and a heat-resisting elastic layer 19 which covers the outer periphery of the mandrel 18. If necessary, a thermal sensor may be arranged in contact with the outer periphery of the pressure roller 5 to detect a temperature thereof for controlling the assistant heater 12. The pressure roller 5 is also drivingly connected with a motor 20 so that it can be rotated in a direction shown by an arrow 21.

Although an efficiency of fixing will increase in proportion to the pressure applied between the drive roller 3 and the pressure roller 5, an excess pressure will cause a flattening of the toner image 17 while too little pressure will cause a mis-fixing of the same. Further, the excess pressure between the pressure roller 5 and the rollers 3 and 7 will increase a sliding resistance against the belt 4, which makes it difficult to cancel the steering of the belt 4. Therefore, the pressure is preferably restricted to 1.5 $kg/cm^2$ or less, more preferably 0.7 $kg/cm^2$ or more.

The pressure applied between the pressure roller 5 and the assist roller 7 is set to be lower than that applied between the drive roller 3 and the pressure roller 5 and is preferably determined to 0.3 $kg/cm^2$ or less, more preferably 0.2 $kg/cm^2$ or less.

Also, the pressure should be determined with taking the following into account. Because the surface of the pressure roller 5 is made of elastic material, applying pressure on the roller by another roller will cause a deformation thereof, or cave, in its surface portion being in contact with the other roller. Also, this further results in changes of the respective peripheral speeds of the roller and the belt and in turn the recording medium transporting speed at the caved portion, which occurs a slip between contacting surfaces of the belt and the recording medium to be transported thereby and further a disturbance of the toner image supported on the recording medium. Therefore, to minimize the deformation, the fixing pressure applied between the drive roller 3 and the pressure roller 5 should be carefully determined.

However, reducing both pressures applied on the drive roller 3 and the assist roller 7 will lead a shortening of the nipping region. Therefore, one of the two pressures must be kept high. Also, immediately after a portion of the recording medium has entered the nipping region, enough amount of heat cannot be obtained by the recording medium yet, and therefore even if a high pressure is applied on the recording medium entering side of the nipping region, it is difficult to perform an efficient toner fixing. Accordingly, it is more preferable to set the pressure applied on the drive roller 3 which is disposed on a downstream side with respect to the recording medium moving direction higher than that applied on the assist roller 7 for elevating the efficiency of toner fixing.

Also, since in this belt fixing device, the roller disposed on a downstream side with respect to the recording medium moving direction is the drive roller 3, it is further preferable to apply a higher pressure on the drive roller 3 than the assist roller 7 for efficient transmission of a driving force to the belt 4.

Further, as the outer periphery layer of the drive roller 3 is covered by the heat-resisting elastic layer 12 so that a porion of the layer 12 pressed on the pressure roller 5 is deformed. As a result, the radius of the drive roller 3 at this deformed portion is a bit smaller than that of reminding portion thereof. Also, the friction caused between the drive roller 3 and the pressure roller 5 in the deformed portion is elevated than that of the remaining portion. Accordingly, the peripheral speed of the drive roller 3 is designed to be about 1.01 to 1.02 times as large as that of the pressure roller 5 so that the belt 4 moves in the nipping region in synchronism with the pressure roller 5.

Similar to the drive roller 3, the assist roller 7 consists of a metal mandrel and a heat-resisting elastic coating layer which covers the outer periphery of the mandrel. This assist roller 7 is connected at its one end with a braking device (not shown) for providing the roller with a braking power. This braking power is designed to be smaller than respective friction forces generated between the drive roller 3 and the belt 4 and between the assist roller 7 and the belt 4. With this braking power, a belt portion, in the nipping region, extending from the assist roller 7 to the drive roller 3 is stretched and then pressed on the associated outer periphery portion of the pressure roller 5. As a result, the recording medium 16 and the toner image 17 supported thereon are brought into close contact with the belt 4 in the nipping region, which permits the recording medium 16 and the toner image 17 to be heated efficiently.

Although the assist roller 7 is arranged inside and adjacent the belt 4 to press it against the outer periphery of the pressure roller 5, this roller may be replaced by another elastic member in the form of blade or bar.

In operation, the recording medium 16 onto which the toner image 17 has been transferred at an unillustrated image forming station is transported in the direction of arrow 22 and then entered in the nipping region 6. In the nipping region 6, the toner image 17 is brought into contact with the belt 4 heated by the main heater 10 and then fixed on the recording medium 16.

As apparent from the above, the heat roller 2 is preferably made of metal for efficient heat transfer. According to this embodiment, the heat roller 2 made of metal is arranged apart from the pressure roller 5 while the assist roller 7 and the drive roller 3 both covered at their peripheral surfaces with elastic materials, respectively, are arranged inside the belt and pressed against the pressure roller 5 through the belt 4. Due to this arrangement, the toner image 17 supported on the recording medium 16 will not be flattened and keeps its original shape. Also, especially in fixing a full-color image which is formed by super-imposing a plurality of toner images onto a recording medium, a remarkable effect of the above embodiment appears.

(2) SECOND EMBODIMENT

Figure 2:
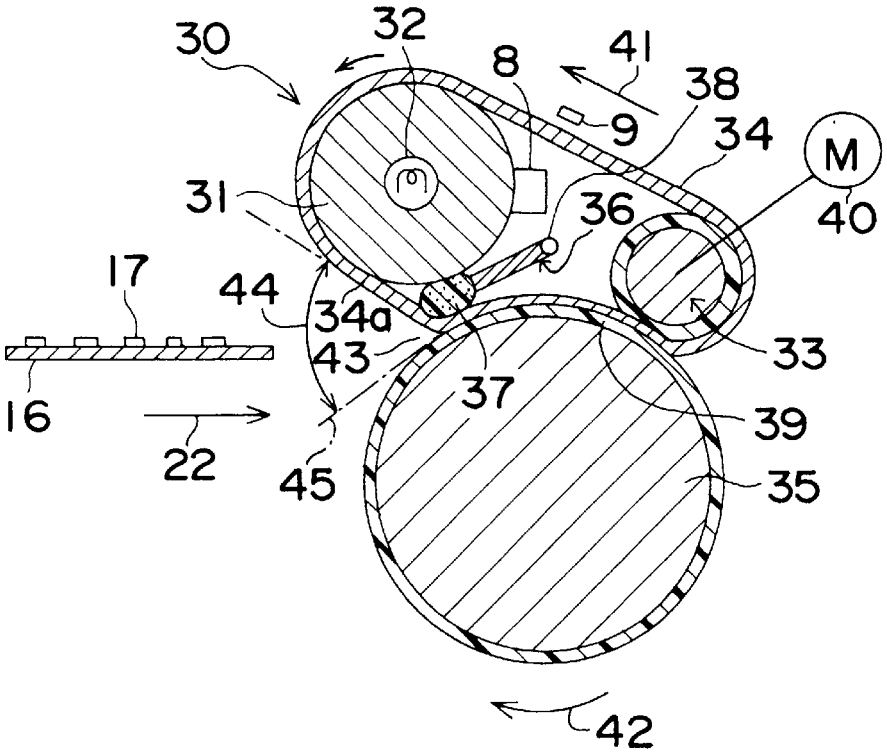
FIG. 2 is a sectional view of the belt fixing device of the second embodiment.

Referring to FIG. 2, a second embodiment of the invention will be described below. A belt fixing device 30 comprises a rotatably mounted heat roller 31 having a heater 32 as a heat generator, a drive roller 33 arranged parallel to the heat roller 31 and spaced a predetermined distance therefrom, and a fixing belt 34 entrained around the rollers 31 and 33. A pressure roller 35 is so arranged below the belt 34 as to contact with an outer periphery of the belt 34. Although no heater is included in the pressure roller 35 in this embodiment, a suitable heat generator may be arranged in the roller 35.

Arranged inside the belt 34 is an assist member 36 which carries at one end an elastic portion 37. The assist member 36 is hinged at its opposite end on a shaft 38 and its elastic portion 37 is disposed between the heat roller 31 and the pressure roller 35 so that a belt portion between the elastic portion 37 and the drive roller 33 is brought into circumferential contact with a peripheral surface of the pressure roller 35 to form an extended nipping region 39 with the pressure roller 35.

Note that because the assist member 36 is positioned and held as described above, there is no need to provide a bearing and the like for supporting. This simplifies the construction of the belt fixing device.

The elastic portion 37 of the assist member 36 is made of heat-resistant elastic member, and may be made from felt or cloth formed by heat-resisting fibers, which enables the portion 37 to clean the inner periphery surface of the belt 34 on which dust has generated after long use.

The drive roller 33 is drivingly connected with a motor 40 so that upon rotation thereof the rollers 31, 33, and 35 rotates in the direction indicated by respective arrows and the belt 34 moves in the direction indicated by arrow 41.

In such belt fixing device 30, when the roller 35 and the belt 34 rotate, air streams are generated therearound along respective rotational directions. Then, the air streams generated by their rotations collide each other at a corner 43 defined by the belt 34 and the roller 35 on the upstream side of the nipping region to possibly form a turbulence of air at that corner. This turbulence may blow the unfixed toner image off from the recording medium, thereby deteriorating the resultant image. In this embodiment, however, the belt fixing device 30 is so designed that a belt portion 34*a* extending from the heat roller 31 to the nipping region 39 forms a large angle 44 with a tangential line 45 of the pressure roller 35. With this design, turbulence in the corner 43 is reduced, and even if turbulence occurs, there has little influence on an unfixed toner image on a recording medium. This arrangement is particularly effective for a high speed image forming apparatus, because the fixing belt to be used in such high speed machine will be rotated at rather high speed and therefore tends to generate such turbulence.

In operation, the recording medium 16 supporting the unfixed toner image 17 is transported in the direction of arrow 22 and then nipped adjacent the elastic portion 37 of the assist member 36 by the belt 34 and the pressure roller 35. Also, the toner image 17 is brought into contact with the belt 34 heated by the contact of heat roller 31 and then fixed on the recording medium 16.

According to the embodiment, the extended nipping region is formed between the belt and the pressure roller, which results in an extended dwelling time of the recording medium in the nipping region. This ensures that the toner image and even the superimposed color-toner images can be fully heated and then fixed on the recording medium. Further, as the belt is softly forced by the elastic back-up member towards the recording medium and the toner image, the toner image will not be flattened.

(3) THIRD EMBODIMENT

Figure 3:
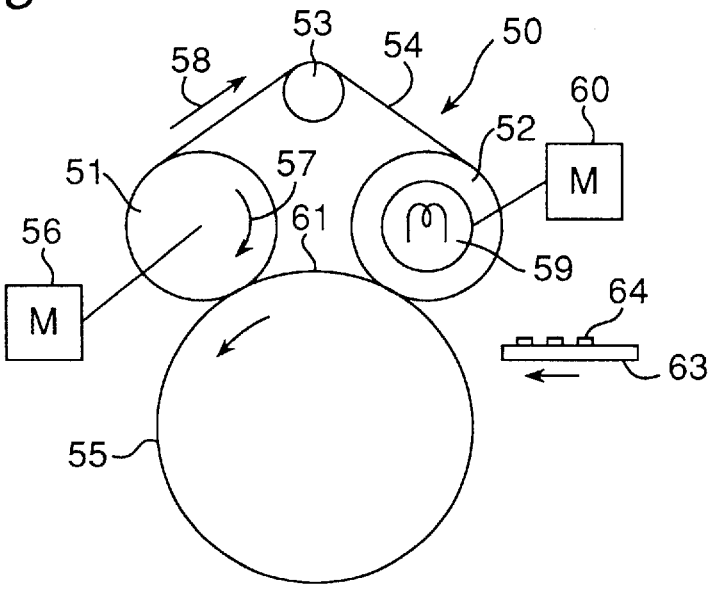
FIG. 3 is a side elevational view of a belt fixing device of the third embodiment.

Referring to FIG. 3, a belt fixing device 50 of the third embodiment includes rotatably mounted three rollers 51, 52, and 53 spaced apart from each other, an endless heat-resisting fixing belt 54 entrained around the rollers 51, 52, and 53, and a pressure roller 55 arranged outside the belt 54. Also, the pressure roller is forced toward the rollers 51 and 52 by a suitable biasing member such as spring and thereby brought into circumferential contact with an outer periphery of a belt span running between roller 51 and 52.

Among others, the roller 51 is drivingly connected with a drive motor 56 so as to rotate in the direction indicated by an arrow 57, thereby rotating the belt 54 in the direction indicated by arrow 58. The roller 52 includes a heater 59 for heating the roller 52 and further heating a belt portion to be contacted therewith. The roller 52 is drivingly connected with a braking motor 60. In this embodiment, a peripheral speed of the roller 52 driven by the braking motor 60 is designed to be a bit lower than that of the roller 51 driven by the drive motor 56. The roller 53 is biased outwardly by a biasing means such as spring so that the belt 54 is stretched with a proper tension.

The belt 54 is preferably made from a film, having a thickness of 30 to 100 $\mu$m, made of resin such as polyamide, polyetherimide, polyamideimide, polyester-sulfone, polyetherketone, or a film of metal such as nickel, stainless, or copper. Further, the outer periphery of the belt 54 is preferably coated with an offset-preventing layer made of resin such as silicone or fluoroethylene.

In operation, upon driving the drive motor 56 the roller 51 rotates in the direction of arrow 57. This rotates the belt 54 in the direction of arrow 58. Also, the roller 52 is rotated by the braking motor 60. As described above, the peripheral speed of the roller 52 is slightly lower than that of the roller 51 so that the portion of the belt supported between the rollers 51 and 52 is stretched and thereby brought into close contact with the outer peripheral surface of the pressure roller 55 to form an extended nipping region 61 therewith. Further, the belt 54 is heated by the contact with the roller 52 heated by the heater 59.

Therefore, when a recording medium 63 supporting thereon an unfixed toner image 64 is transported into the nipping region 61, the toner image 64 is brought into contact with the belt 54 and thereby heated to melt evenly while moving past the nipping region. Then the melted toner image 64 is fixed on the recording medium 63 by pressure applied by the pressure roller 55.

(4) FOURTH EMBODIMENT

Figure 4:
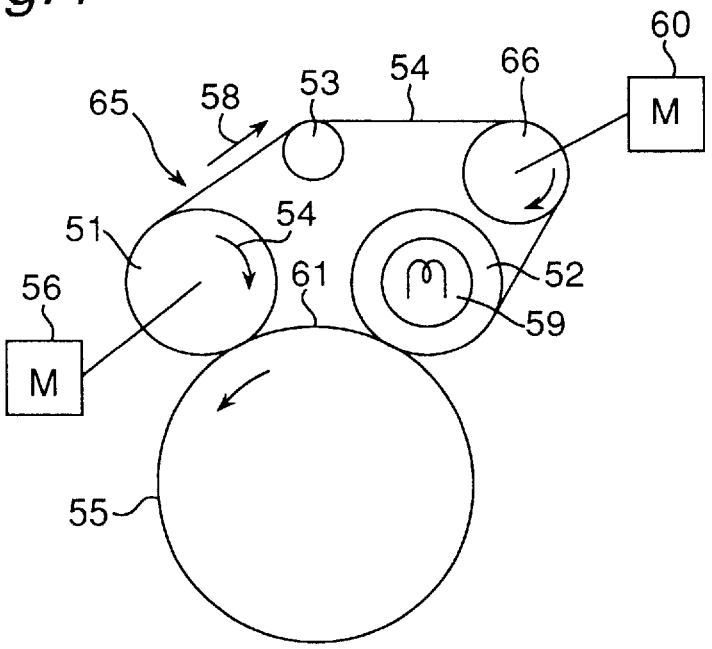
FIG. 4 is a side elevational view of the belt fixing device of the fourth embodiment.

Referring to FIG. 4, a belt fixing device 65 of the fourth embodiment will be described. The belt fixing device 65, which is a modification of the third embodiment, comprises a roller 66 which supports the belt 54 between the rollers 52 and 53. The roller 66 is drivingly connected with the braking motor 60. Also, a rotational speed of the braking motor 60 is so designed that the peripheral speed of the roller 66 is slightly lower than that of the roller 51, which ensures the belt portion 61 between the rollers 51 and 52 to be stretched and thereby brought into close contact with the pressure roller 55.

With this arrangement, once the recording medium is entered in the nipping region 61, the toner image is brought into close contact with the heated belt 54 and then entirely fixed on the recording medium.

(5) FIFTH EMBODIMENT

Figure 5:
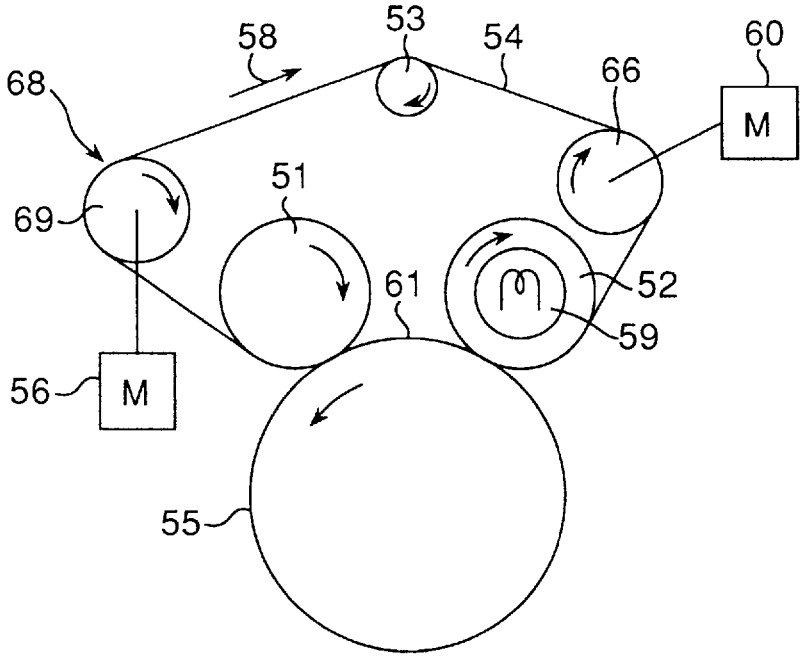
FIG. 5 is a side elevational view of a belt fixing device of the fifth embodiment.

Referring to FIG. 5, a belt fixing device 68 of the fifth embodiment will be described. The belt fixing device 68, which is a modification of the fourth embodiment, further includes a roller 69 for supporting the belt 54. Also, the drive motor 56 is connected with the roller 69 while the braking motor 60 is connected with the roller 66. Further, a peripheral speed of the roller 66 is set to be slightly lower than that of the drive roller 69. Thereby, a belt span running between the rollers 51 and 52 is stretched and then pressed against the pressure roller 55. Consequently, the toner image supported on the recording medium contacts with the heated belt and then fixed on the recording medium.

(6) SIXTH EMBODIMENT

Figure 6:
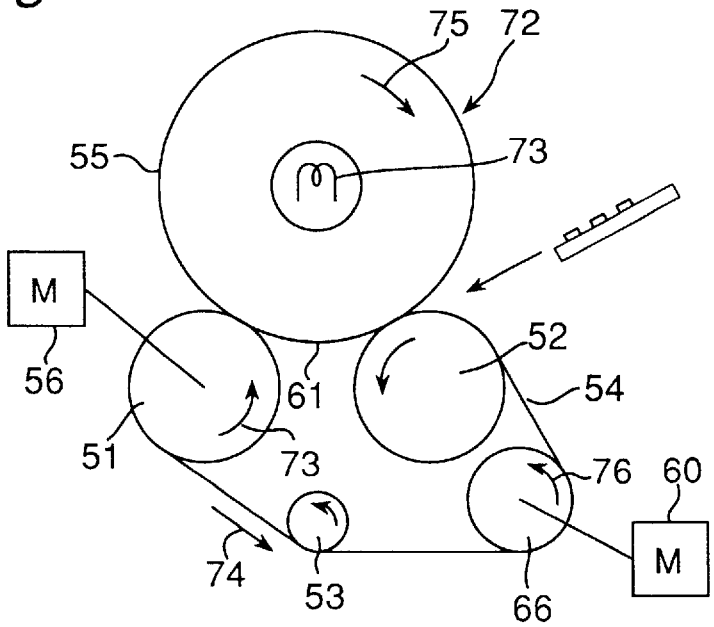
FIG. 6 is a side elevational view of the belt fixing device of the sixth embodiment.

Referring to FIG. 6, a belt fixing device 72 of the sixth embodiment will be described. In this belt fixing device 72, the pressure roller 55 includes heater 73 as a heat generator, and the belt 54 is arranged below the pressure roller 55 so that the belt span between the rollers 51 and 52 is in contact with a bottom peripheral surface of the pressure roller 55.

In operation, the roller 51 is rotated by the drive motor 56 in the direction indicated by an arrow 73 thereby rotating the belt 54 in the direction of arrow 74 at the same peripheral speed as the roller 51. By the rotation of the belt 54, the rollers 52 and 53 are rotated in the directions indicated by respective arrows and the pressure roller 55 is rotated in a direction of arrow 75. Also, the roller 66 is rotated by the braking motor 60 in the direction of arrow 76. However, the peripheral speed of the roller 66 is set to be slightly lower than that of roller 51 and belt 54 driven thereby so that a portion of the belt 54 contacting with the pressure roller 55 between the rollers 51 and 52 is stretched and pressed against the pressure roller 55. Therefore, the toner image supported on the recording medium is brought into close contact with the pressure roller 55 and heated evenly and eventually fully heated and fixed on the recording medium.

(7) SEVENTH EMBODIMENT

Figure 7:
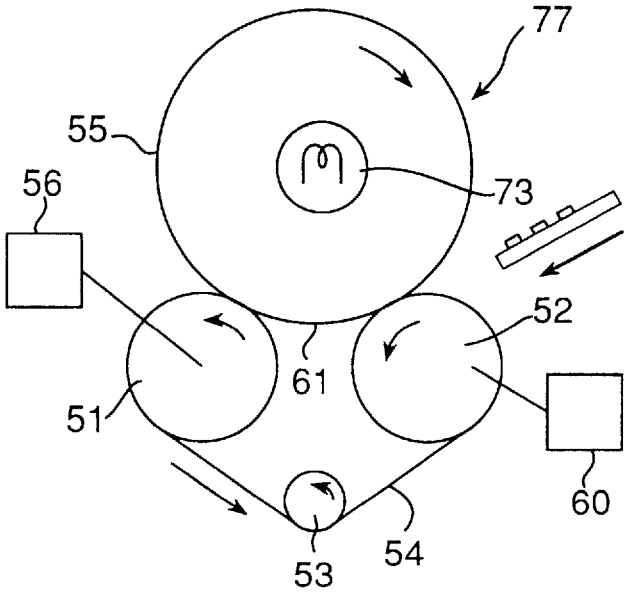
FIG. 7 is a side elevational view of a belt fixing device of the seventh embodiment.
Figure 8:
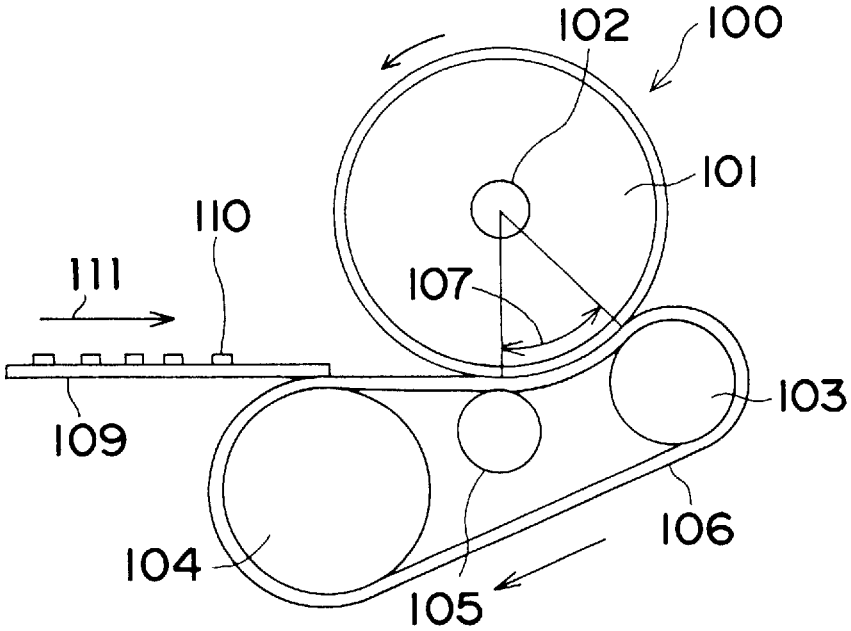
Fig. 8 PRIOR ART
FIG. 8 is a side elevational view of the prior art belt fixing device.
Figure 9:
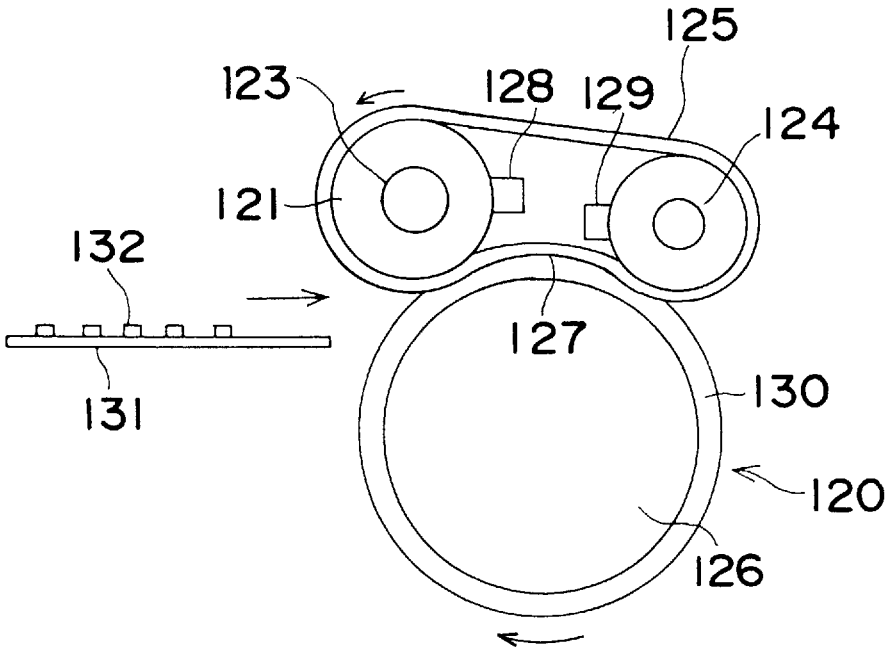
Fig. 9 PRIOR ART
FIG. 9 is side elevational view of another prior art belt fixing device.

Referring to FIG. 7, a belt fixing device 77 of the seventh embodiment will be described. The belt fixing device 77 is a simplified modification of the sixth embodiment. In this belt fixing device 77, the roller 52 is drivingly connected with the braking motor 60 and a peripheral speed of the roller 52 is designed to be slightly lower than that of the roller 51. Therefore, a portion of the belt 61 between the rollers 51 and 52 is so stretched as to be in close contact with the pressure roller 55, which ensures toner image to be fully heated and fixed in the region by the pressure roller 55.

Although in the third to seventh embodiments the belt is rotated by the rotation of the belt supporting roller, the pressure roller may be connected with the drive motor so as to rotate the belt and the rollers supporting the belt. In this situation, one of the two rollers, which is opposed to the pressure roller and arranged on a downstream side with respect to the recording medium transporting direction, is preferably forced on the opposing pressure roller with a higher pressure than that of the other roller, thereby stretching the belt portion in the nipping region.

Although the motor is used for braking the roller, it can be replaced by other means, e.g., torque limiter for controlling torque, capable of stretching the belt portion contacting with the pressure roller.

Further, another roller for forcing the belt against the pressure roller may be arranged inside the belt.

Furthermore, the driving and braking motors may be connected with other rollers provided that the belt portion contacting with the pressure roller is stretched and pressed thereagainst.

In addition, whether the toner image is brought into contact with the belt or fixing device is not limited to the above described embodiment.

What is claimed is:

1. A fixing device, comprising:

a first roller;

a second roller arranged substantially parallel to said first roller;

a fixing belt entrained around said first and second rollers;

a third roller arranged outside the belt and substantially parallel to said first and second rollers;

a forcing member made of elastic member, said forcing member being arranged inside said belt to force a portion of said belt to said third roller so that said belt portion is in circumferential contact with said third roller to form an extended nipping region therewith; and a heater for heating a portion of said belt moving into said nipping region.

2. A fixing device claimed in claim 1, wherein said first roller is made of metal and said heater is provided in said first roller.

3. A fixing device claimed in claim 2, wherein said forcing member is held between the first roller and said third roller, and in contact with the first roller.

4. A fixing device claimed in claim 1, wherein said second roller is forced upon said third roller with a pressure in the range of 0.7 $kg/cm^2$ to 1.5 $kg/cm^2$.

5. A fixing device claimed in claim 4, wherein said forcing member is forced upon said third roller with a pressure less than 0.3 $kg/cm^2$.

6. A fixing device as claimed in claim 1, wherein the heater is located at a position upstream of the nipping region.

7. A fixing device as claimed in claim 1, wherein the heater is located at a position such that the portion of the belt is upstream of the nipping region when it is heated.

8. A fixing device, comprising:

a first roller;

a second roller arranged substantially parallel to the first roller;

an endless fixing belt entrained around by the first and second rollers;

a third roller arranged outside the belt;

a forcing member made of elastic member, said forcing member being arranged inside said belt to force a belt outwardly to said third roller so that said belt is in circumferential contact with said third roller to form an extended nipping region therewith where a recording medium supporting an unfixed toner image is nipped;

means for rotating said belt in one direction; and a heater for heating the belt said heater being mounted inside said belt and at an upstream side of the nipping region with respect to the rotational direction of the belt.

9. A fixing device as claimed in claim 8, wherein the belt is so arranged as to contact with said toner image supported on the recording medium.

10. A fixing device, comprising:

a plurality of supporting rollers;

a fixing belt entrained around said supporting rollers;

a pressure roller which is arranged outside the belt in circumferential contact with a span of belt at a nipping region;

one of the supporting rollers is arranged downstream of the nipping region and a second of the supporting rollers is arranged upstream of the nipping region;

heating means for heating said belt;

drive means for rotating said belt in one direction, said drive means connected to the one supporting roller to drive the one supporting roller; and control means for stretching and pressing said belt span against said pressure roller.

11. A fixing device, comprising:

a first roller;

a second roller arranged parallel to and spaced apart from said first roller;

a belt entrained around said first and second rollers;

a pressure roller disposed outside said belt in circumferential contact with a span of belt extending from said first roller to said second roller to form an extended nipping region therewith;

drive means for rotating said belt in one direction, said drive means being provided on a downstream side of said nipping region with respect to said direction; and braking means provided on an upstream side of said nipping region with respect to said direction for stretching said belt span.

12. A fixing device comprising:

a plurality of supporting rollers;

a fixing belt entrained around said supporting rollers;

a pressure roller which is arranged outside the belt in circumferential contact with a span of belt at a nipping region;

one of the supporting rollers is arranged downstream of the nipping region and a second of the supporting rollers is arranged upstream of the nipping region;

heating means for heating said belt;

drive means for rotating said belt in one direction so that the belt at the nipping region is pulled downstream with a force of the drive means; and control means for stretching and pressing said belt span against said pressure roller.

13. A fixing device claimed in claim 12, wherein said driving means is drivingly connected with the one of said supporting rollers so that said belt is rotated according to a rotation of said one supporting roller and in turn said pressure roller is rotated according to a rotation of said belt.

14. A fixing device claimed in claim 12, wherein said drive means is further connected with said pressure roller.

* * * * *